US010062949B2

(12) United States Patent
Cheng et al.

(10) Patent No.: US 10,062,949 B2
(45) Date of Patent: Aug. 28, 2018

(54) INTEGRATED MULTI-BAND BANDPASS FILTERS BASED ON DIELECTRIC RESONATORS FOR MOBILE AND OTHER COMMUNICATION DEVICES AND APPLICATIONS

(71) Applicants: ZTE Corporation, Shenzhen (CN); ZTE Canada Inc., Toronto (CA)

(72) Inventors: Dajun Cheng, Kanata (CA); Hongwei Zhang, Shanxi (CN)

(73) Assignees: ZTE Corporation, Shenzhen (CN); ZTE Canada Inc., Toronto (CA)

( * ) Notice: Subject to any disclaimer, the term of this patent is extended or adjusted under 35 U.S.C. 154(b) by 133 days.

(21) Appl. No.: 14/927,440

(22) Filed: Oct. 29, 2015

(65) Prior Publication Data

US 2016/0126622 A1 May 5, 2016

(51) Int. Cl.

| | |
|---|---|
| ***H01Q 1/50*** | (2006.01) |
| ***H01P 7/10*** | (2006.01) |
| ***H01P 5/10*** | (2006.01) |
| ***H01Q 5/30*** | (2015.01) |
| ***H01Q 5/50*** | (2015.01) |

(52) U.S. Cl.

CPC ..... *H01P 7/10* (2013.01); *H01P 5/1022* (2013.01); *H01Q 5/30* (2015.01); *H01Q 5/50* (2015.01)

(58) Field of Classification Search

CPC ... H01Q 5/30; H01Q 5/50; H01P 7/10; H04B 7/0413

USPC ..... 343/860

See application file for complete search history.

(56) References Cited

U.S. PATENT DOCUMENTS

| | | | | |
|---|---|---|---|---|
| 2005/0030133 | A1* | 2/2005 | Rawnick | H01P 7/06 333/231 |
| 2007/0024399 | A1* | 2/2007 | Martin Antolin | H01P 1/2013 333/205 |
| 2011/0037529 | A1* | 2/2011 | Kishimoto | H01P 1/387 333/24.2 |
| 2012/0184231 | A1* | 7/2012 | Cheng | H01P 1/203 455/129 |
| 2014/0104136 | A1* | 4/2014 | Werner | H01Q 9/32 343/900 |
| 2016/0294031 | A1 | 10/2016 | Cheng et al. | |
| 2017/0295007 | A1 | 10/2017 | Cheng | |

* cited by examiner

*Primary Examiner* — Huedung Mancuso
(74) *Attorney, Agent, or Firm* — Perkins Coie LLP

(57) ABSTRACT

Multi-band radio frequency communication is performed using an integrated multi-band bandpass filter implemented based on ring resonators, such as concentric dielectric ring resonators. By constructing the multi-band bandpass filter using concentric ring configurations, the print circuit board (PCB) real estate requirement of multiple filters operating at multiple frequency bands is significantly reduced. Various configurations of the multi-band bandpass filter based on the concentric ring resonators provide flexibility in the layout design and manufacturing of multi-band radios for mobile devices, such as compact smartphones. These configurations of the concentric ring resonators can include but are not limited: a slot-coupling configuration, a direct-coupling configuration, and an embedded direct-coupling configuration.

20 Claims, 15 Drawing Sheets

INTEGRATED MULTI-BAND BANDPASS FILTERS BASED ON DIELECTRIC RESONATORS FOR MOBILE AND OTHER COMMUNICATION DEVICES AND APPLICATIONS

CROSS REFERENCE TO RELATED APPLICATIONS

This patent document claims the benefit of priority under 35 U.S.C. § 119(a) and the Paris Convention of International Patent Application No. PCT/CN2014/089948, filed on Oct. 30, 2014. The entire content of the before-mentioned patent application is incorporated by reference herein.

TECHNICAL FIELD

This patent document relates to communication signal processing and management, including processing and management of radio frequency (RF) communication signals.

BACKGROUND

Signals at different carrier frequencies are used in various applications, such as multi-band RF signals used in wireless and other communication devices or systems. Examples of multi-band RF communication technologies include CDMA bands BC0/1, GSM bands 2/3/5/8, WCDMA bands 1/2/4/5/6/8, LTE bands 1/2/3/4/5/7/8/12/13/17/20/25/26/38/40/41, GPS, Wi-Fi (2.4 GHz and 5 GHz bands), and others.

Various commonly used multi-band multi-radio system designs are based on a combination of multiple single-bandpass filters (or duplexers) and switches for handling multi-band radio operations, such as out-of-band noise floor and spur, antenna isolation. Such single-bandpass filters are discrete devices and are typically used to separately filter their corresponding RF signals at different RF carrier frequencies, respectively.

SUMMARY

The technology disclosed in this patent document provides, among others, systems, devices and techniques for using dielectric resonators at different resonance frequencies to filter different signals at different frequencies within a multi-band signal, such as multi-band radio frequency communication signals. In the examples provided in this document, such dielectric resonators are integrated as a multi-band bandpass filter which can be configured in a compact size suitable for mobile phones or other compact communication or electronic devices of multi-band operations. For each individual frequency band, the corresponding dielectric resonator can be a single dielectric resonator or a combination of electromagnetically coupled dielectric resonators that have similar resonator frequencies to collectively provide the desired signal filtering at the particular frequency band.

Different from other RF filters used in mobile phones, tablets and other RF communication devices, each dielectric resonator in a multi-band bandpass filter based on the disclosed technology is all dielectric without a conductive element and can be configured to achieve a high quality factor at a corresponding RF band. To some extent, the filtering operation by the dielectric resonators in the disclosed technology resembles a photonic dielectric resonator in the optical domain.

Specific examples of integrated multi-band bandpass filters are disclosed by using dielectric ring resonators, such as concentric dielectric ring resonators to replace multiple spatially-separated RF bandpass filters distributed in multiple frequency bands. Using the integrated multi-band bandpass filter, multiple desired passbands corresponding to the multiple resonant frequencies of the multiple ring resonators can be simultaneously filtered in processing multi-band RF signals. By constructing the integrated multi-band bandpass filter using concentric ring configurations, the print circuit board (PCB) real estate requirement for multiple bandpass filters operating at multiple frequency bands is significantly reduced. Various configurations of the integrated multi-band bandpass filter based on the concentric ring resonators provide flexibility in the layout design and manufacturing of multi-band radios for mobile devices, such as compact smartphones, mobile phones, portable tablet computers, portable laptop computers, GPS devices, Wi-Fi devices, etc. These configurations of the concentric ring resonators can include but are not limited: a slot-coupling configuration, a direct-coupling configuration, and an embedded direct-coupling configuration.

Various embodiments of the integrated multi-band bandpass filter based on concentric ring resonators can significantly attenuate unwanted signals (e.g., noise signals) without introducing additional insertion loss for the useful signals. These improvements can be attributed to eliminating spatially-separated bandpass filters typically employed in multi-band radio designs and replacing the spatially-separated bandpass filters with a single integrated multi-band bandpass filter. Moreover, by using dielectric materials with high relative permittivity to implement the concentric ring resonators, some embodiments of disclosed technology can achieve very high Q value in the multi-band bandpass filter, thereby providing high rejection to the out-of-band spurious emission and/or interference. Furthermore, because the resonant frequencies of the disclosed ring resonators can be shape-dependent and can be nonlinear functions of the dimensions in the cases of circular or elliptical geometries, the harmonics of a desired pass band of a given filter can be greatly rejected. In other words, various embodiments of the disclosed multi-band bandpass filter (MB-BPF) can also provide rejection at harmonic frequencies. Using the multi-band bandpass filter based on concentric ring resonators also facilitates saving the PCB real estate, reducing the bill of material (BOM) cost, meeting the regulatory emission requirements while supporting simultaneous multi-band radio operations.

In one aspect, an integrated multi-band bandpass filter is disclosed. This multi-band bandpass filter includes a transmission line structure for transmitting and receiving multi-band RF signals. The multi-band bandpass filter also includes a plurality of ring resonators of different sizes and different resonant frequencies electromagnetically coupled to the transmission line structure to transmit and receive the multi-band RF signals. Each of the plurality of ring resonators is configured as a bandpass filter for generating a passband signal having a central frequency corresponding to the associated resonant frequency of the ring resonator.

In some aspects, the transmission line structure includes: a first conductive layer having a signal trace for transmitting and receiving the multi-band RF signals; a second conductive layer configured as a ground plane; and a dielectric substrate positioned between the first conductive layer and the second conductive layer.

In some aspects, each of the plurality of ring resonators is a dielectric ring resonator.

In some aspects, the plurality of ring resonators are coplanar.

In some aspects, the plurality of ring resonators are concentric.

In some aspects, the plurality of ring resonators are disposed on the second conductive layer and electromagnetically coupled to the signal trace through a coupling slot etched into the second conductive layer.

In some aspects, the coupling slot can have a rectangular shape, a bowtie shape, and other nonrectangular shapes.

In some aspects, the plurality of ring resonators are disposed on the first conductive layer and electromagnetically coupled to the signal trace through direct contact.

In some aspects, the plurality of ring resonators are electromagnetically coupled to the signal trace additionally through a coupling stub configured as a part of the signal trace.

In some aspects, the plurality of ring resonators are embedded in the dielectric substrate between the first and second conductive layers and electromagnetically coupled to the signal trace through direct contact.

In some aspects, the transmission line structure includes one of a microstrip transmission line; a coplanar waveguide transmission line; and a stripline transmission line.

In some aspects, the plurality of ring resonators of different sizes and different resonant frequencies include two or more subgroups of ring resonators. Each subgroup of ring resonators further includes two or more ring resonators of closely-spaced resonant frequencies. These two or more ring resonators operate as a single wideband bandpass filter having a bandwidth substantially equal to a combined bandwidth of the two or more ring resonators.

In some aspects, the at least two subgroups of ring resonators include three subgroups of ring resonators corresponding to a low passband, a medium passband, and a high passband, respectively.

In some aspects, the plurality of ring resonators are concentric dielectric circular ring resonators. The gaps between the two or more ring resonators within each subgroup of ring resonators are filled with a low dielectric constant material.

In some aspects, the radii of the two or more ring resonators within each subgroup of ring resonators are separated by a difference $\Delta r1$, the central radii of two adjacent subgroups of ring resonators is separated by a difference $\Delta r1$, and $\Delta r1 \ll \Delta r2$.

In some aspects, the plurality of ring resonators are circular or elliptical ring resonators.

In some aspects, the plurality of ring resonators are rectangular ring resonators. As a result, each of the rectangular ring resonators has two frequency modes In some aspects, the integrated multi-band bandpass filter also includes an assembly frame disposed on the transmission line structure to enclose the plurality of ring resonators to provide a protection structure during handing and assembly of the integrated multi-band bandpass filter.

In some aspects, the plurality of ring resonators are made of a high Q dielectric material.

In another aspect, a multi-band radio frequency (RF) communication device is disclosed. This multi-band RF communication device includes: a multi-band antenna; a band switching circuit; an integrated multi-band bandpass filter coupled between the multi-band antenna and the band switching circuit, and is configured to simultaneously output and input multiple desired passband signals; and multi-band RF circuits coupled to the integrated multi-band bandpass filter through the band switching circuit.

In some aspects, the integrated multi-band bandpass filter further includes: a transmission line structure for transmitting and receiving multi-band RF signals; and a plurality of ring resonators of different sizes and different resonant frequencies electromagnetically coupled to the transmission line structure to transmit and receive the multi-band RF signals. Each of the plurality of ring resonators is configured as a bandpass filter for generating a desired passband signal having a central frequency defined by the associated resonant frequency of the ring resonator.

In some aspects, the multi-band RF circuits includes multiple RF signal bands, and each of the RF signal bands corresponds to a passband within the multiple desired passbands.

In some aspects, the band switching circuit is a time division duplexer (TDD) operable to couple the outputs of the integrated multi-band bandpass filter to one of the multiple RF signal bands at a given time.

In some aspects, the multi-band RF communication device also includes one or more frequency division duplexers (FDDs) coupled to the integrated multi-band bandpass filter through the band switching circuit.

In some aspects, the multi-band RF communication device includes a compact smartphone, a mobile phone, a portable tablet computer, a portable laptop computer, a GPS devices, or a Wi-Fi device.

In a further aspect, a technique for filtering multi-band RF signals within a multi-band RF communication device is described. This technique includes first receiving multi-band RF signals at a multi-band antenna and coupling the multi-band RF signals to an integrated multi-band bandpass filter. The integrated multi-band bandpass filter then filters the multi-band RF signals into multiple desired passband signals; and simultaneously outputs the multiple desired passband signals to a band switching circuit. The band switching circuit then couples the multiple desired passband signals to multi-band RF circuits.

In some aspects, the multi-band RF circuits includes multiple RF signal bands, and the band switching circuit is configured to couple the multiple desired passband signals to one of the multiple RF signal bands at a given time.

In some aspects, the integrated multi-band bandpass filter includes: a transmission line structure for transmitting and receiving electromagnetic signals; and a plurality of ring resonators of different sizes and different resonant frequencies electromagnetically coupled to the transmission line structure, each of the plurality of ring resonators is configured as a bandpass filter for generating a desired passband signal having a central frequency defined by the associated resonant frequency of the ring resonator.

In some aspects, filtering the multi-band RF signals into multiple desired passband signals includes using a process of: coupling the multi-band RF signals from the multi-band antenna to the transmission line structure; transmitting the multi-band RF signals in the transmission line structure; coupling the multi-band RF signals from the transmission line structure to the plurality of ring resonators; generating the desired passband signals having central frequencies corresponding to the associated resonant frequencies of the plurality of ring resonators; and coupling the generated multiple desired passband signals from the plurality of ring resonators back to the transmission line structure.

In yet another aspect, an integrated multi-band bandpass filter is disclosed. This integrated multi-band bandpass filter includes: an input circuit for receiving multi-band RF signals from an antenna; a plurality of ring resonators of different sizes and different resonant frequencies electromagnetically coupled to the input circuit to receive the multi-band RF signals, each of the plurality of ring resonators is configured as a bandpass filter for generating a passband signal having a central frequency corresponding to the associated resonant frequency of the ring resonator; and an output circuit coupled to the plurality of ring resonators and configured to receive the generated multiple passband signals and transmit the generated multiple passband signals to a downstream circuit.

In some aspects, both the input circuit and the output circuit is the same transmission line structure.

This and other aspects and their implementations are described in greater detail in the drawings, the description and the claims.

DETAILED DESCRIPTION

Dielectric resonators can be designed to operate at various electromagnetic frequencies. Optical dielectric resonators are dielectric resonators operating at optical frequencies. In the disclosed technology, dielectric resonators are designed to operate at RF or microwave frequencies and are included in RF or microwave filters for filtering signals at RF or microwave frequencies. Various RF or microwave filters or resonators used in RF or microwave communication devices use conventional electrical circuit components by using conductors or electrically conductive materials. The disclosed technology in this document integrates dielectric resonators without conductors into a multi-band bandpass filter to achieve a high quality factor at a corresponding RF or microwave frequency band.

Figure 1:
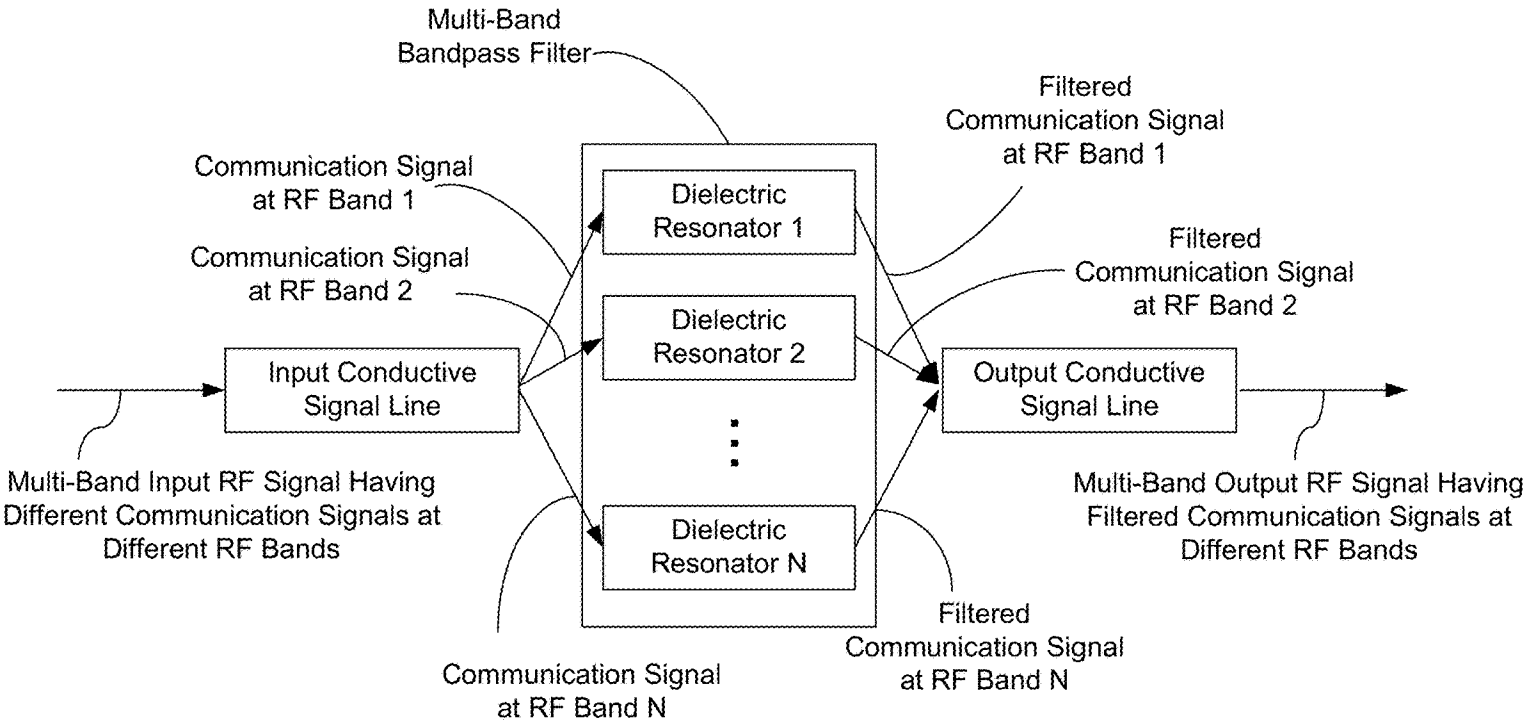
FIG. 1 shows an example of a multi-band bandpass filter circuit having different dielectric resonators at different resonator frequencies that are at or near centers of different bands.

FIG. 1 shows an example of a multi-band bandpass filter circuit having different dielectric resonators at different resonator frequencies that are at or near centers of different bands. A multi-band bandpass filter is provided to include different dielectric resonators that have resonant frequencies at or near the center frequencies of the different bands (Band 1, Band 2, . . . Band N). This filter circuit includes an input conductive signal line that includes metal or electrically conductive material and carries an multi-band input RF signal having different communication signals at different RF frequency bands (e.g., Band 1, Band 2, . . . Band N). This filter circuit also includes an output conductive signal line that includes metal or electrically conductive material and carries the filtered multi-band output RF signal having filtered communication signals at different RF frequency bands (e.g., Band 1, Band 2, . . . Band N). For example, the input/output conductive signal lines may be an RF waveguide or RF stripline. In implementations, the input and output conductive signal lines may be two segments of one common conductive line that is electromagnetically coupled to the dielectric resonators or may be two separate conductive signal lines. The dielectric resonators of the filter are electromagnetically coupled to the input conductive signal line such that the energy in the different RF frequency bands in the input RF signal are coupled into the dielectric resonators and thus are separated via this coupling. As illustrated, the communication signal at RF Band 1 is coupled into the Dielectric Resonator 1, the communication signal at RF Band 2 is coupled into the Dielectric Resonator 2, and so on. Once coupled into a corresponding dielectric resonator, the RF signal bounces back and forth or circulates within the dielectric resonator and is filtered by the dielectric resonator. The filtered signal in the dielectric resonator is centered at the resonance frequency of the dielectric resonator and has a spectral bandwidth that is dictated by the resonator quality factor Q. This filtered signal in the dielectric resonator is then coupled to the output conductive signal line as output of the filter circuit.

In the examples provided in this document, each dielectric resonator can be a designed to have a high quality factor to enable sharp roll off for use in densely spaced frequency bands. For each individual frequency band, the corresponding dielectric resonator can be a single dielectric resonator or a combination of electromagnetically coupled dielectric resonators that have similar resonator frequencies to collectively provide the desired signal filtering at the particular frequency band. In addition, the dielectric resonators in FIG. 1 can be configured in a compact size suitable for mobile phones or other compact communication or electronic devices of multi-band operations.

In applications, the filter circuit in FIG. 1 can be used as a two-way filter where the input/output conductive lines can be used for both receiving and output RF signals. For example, in a wireless transceiver device, the filter circuit in FIG. 1 can use the input line to receive a downlink signal from a base station and outputs the filtered signal to the output line. The same filter circuit can also uses the labeled output line to receive an uplink signal to be sent to a base station while the labeled input line in FIG. 1 is used to output the filtered uplink signal to an antenna of the wireless device for transmission.

In the specific examples disclosed below, such an integrated multi-band bandpass filter can use compact ring resonators, such as concentric dielectric ring resonators to replace multiple spatially-separated RF bandpass filters distributed in multiple frequency bands. Using the integrated multi-band bandpass filter, multiple desired passbands corresponding to the multiple resonant frequencies of the multiple ring resonators can be simultaneously generated from multi-band RF signals. By constructing the integrated multi-band bandpass filter using concentric ring configurations, the print circuit board (PCB) real estate requirement for multiple bandpass filters operating at multiple frequency bands is significantly reduced. Various configurations of the integrated multi-band bandpass filter based on the concentric ring resonators are disclosed to provide flexibility in the layout design and manufacturing of multi-band radios for mobile devices, such as compact smartphones, mobile phones, portable tablet computers, portable laptop computers, GPS devices, Wi-Fi devices, etc. These configurations of the concentric ring resonators can include but are not limited: a slot-coupling configuration, a direct-coupling configuration, and an embedded direct-coupling configuration.

Various embodiments of the integrated multi-band bandpass filter based on concentric ring resonators can significantly attenuate unwanted signals (e.g., noise signals) without introducing additional insertion loss for the useful signals. These improvements can be attributed to eliminating spatially-separated bandpass filters typically employed in multi-band radio designs and replacing the spatially-separated bandpass filters with a single integrated multi-band bandpass filter. Moreover, by using dielectric materials with high relative permittivity to implement the concentric ring resonators, some embodiments of disclosed technology can achieve very high Q value in the multi-band bandpass filter, thereby providing high rejection to the out-of-band spurious emission and/or interference. Furthermore, because the resonant frequencies of the disclosed ring resonators can be shape-dependent and can be nonlinear functions of the dimensions in the cases of circular or elliptical geometries, the harmonics of a desired pass band of a given filter can be greatly rejected. In other words, various embodiments of the disclosed multi-band bandpass filter (MB-BPF) can also provide rejection at harmonic frequencies. Using the multi-band bandpass filter based on concentric ring resonators also facilitates saving the PCB real estate, reducing the bill of material (BOM) cost, meeting the regulatory emission requirements while supporting simultaneous multi-band radio operations.

In one aspect, an integrated multi-band bandpass filter is disclosed. This multi-band bandpass filter includes a transmission line structure for transmitting and receiving multi-band RF signals. The multi-band bandpass filter also includes a plurality of ring resonators of different sizes and different resonant frequencies electromagnetically coupled to the transmission line structure to receive the multi-band RF signals. Each of the plurality of ring resonators is configured as a bandpass filter for generating a passband signal having a central frequency corresponding to the associated resonant frequency of the ring resonator.

In another aspect, a multi-band radio frequency (RF) communication device is disclosed. This multi-band RF communication device includes: a multi-band antenna; a band switching circuit; an integrated multi-band bandpass filter coupled between the multi-band antenna and the band switching circuit, and is configured to simultaneously outputs multiple desired passbands; and multi-band RF circuits coupled to the integrated multi-band bandpass filter through the band switching circuit.

In a further aspect, a technique for filtering multi-band RF signals within a multi-band RF communication device is described. This technique includes first receiving multi-band RF signals at a multi-band antenna and coupling the multi-band RF signals to an integrated multi-band bandpass filter. The integrated multi-band bandpass filter then filters the multi-band RF signals into multiple desired passband signals; and simultaneously outputs the multiple desired passband signals to a band switching circuit. The band switching circuit then couples the multiple desired passband signals to multi-band RF circuits.

In yet another aspect, an integrated multi-band bandpass filter is disclosed. This integrated multi-band bandpass filter includes: an input circuit for receiving multi-band RF signals from an upstream circuit, a plurality of ring resonators of different sizes and different resonant frequencies electromagnetically coupled to the input circuit to receive the multi-band RF signals, each of the plurality of ring resonators is configured as a bandpass filter for generating a passband signal having a central frequency corresponding to the associated resonant frequency of the ring resonator; and an output circuit coupled to the plurality of ring resonators and configured to receive the generated multiple passband signals and transmit the generated multiple passband signals to a downstream circuit.

Figure 2A:
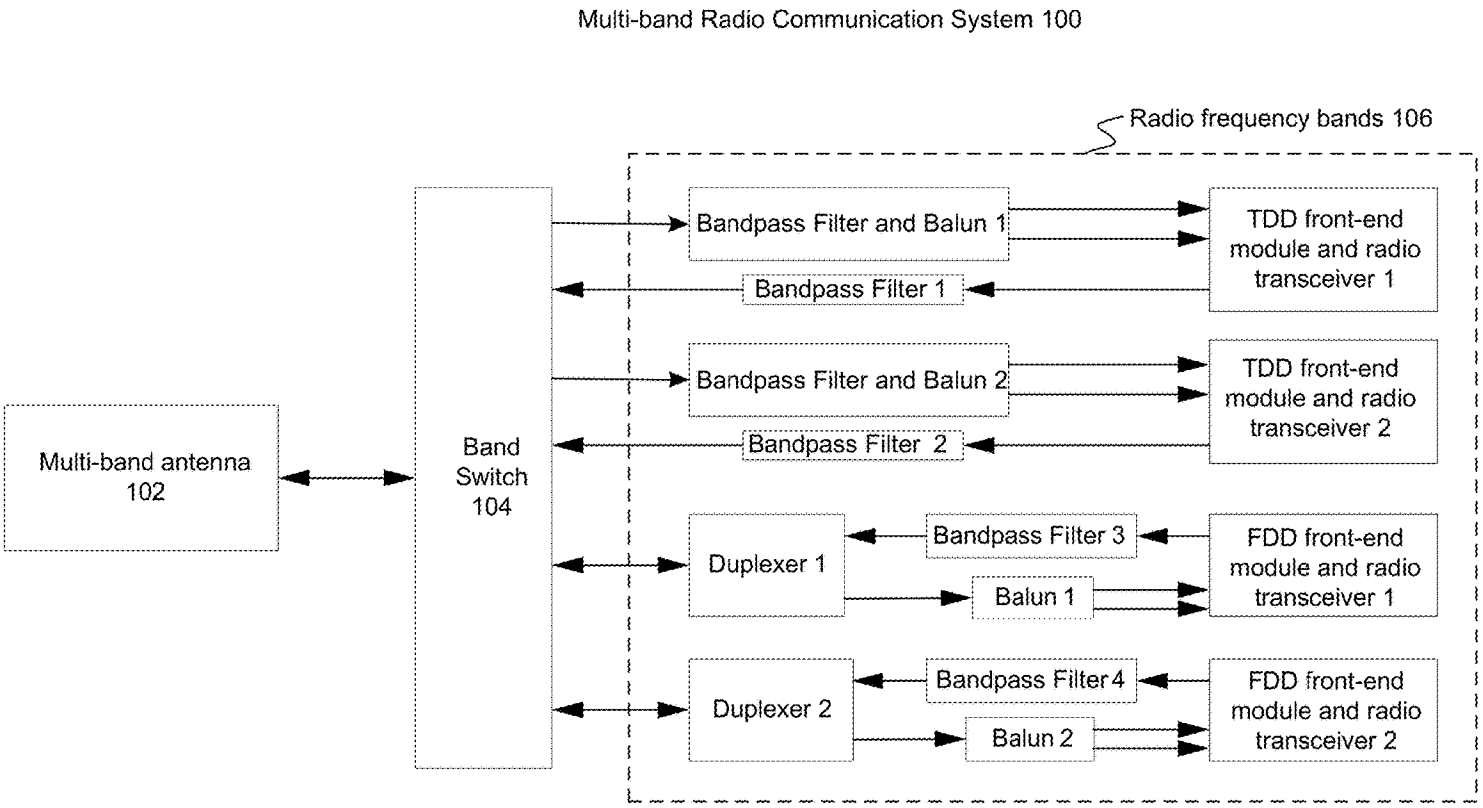
FIG. 2A illustrates a block diagram of an exemplary multi-band radio communication system based on using multiple discrete single-band-bandpass filters.

In a multi-band radio communication system, one commonly-used architecture includes a combination of multiple spatially-separated single-band bandpass filters (or duplexers) and switches. In other words, the multiple spatially-separated single-band bandpass filters are distributed in different frequency channels for generating different operational frequency bands. FIG. 2A illustrates a block diagram of an exemplary multi-band radio communication system based on using multiple single-band-bandpass filters. This example of a multi-band radio communication system 100 includes a multi-band antenna 102, a band switch 104, and a plurality of radio frequency (RF) bands 106. Multi-band antenna 102 is configured to transmit and receive multi-band RF signals. Band switch 104 is coupled between the multi-band antenna 102 and the plurality of radio frequency bands 106 and operable to connect multi-band antenna 102 to one of the radio frequency bands 106. In one embodiment, band switch 104 is a time division duplex (TDD) switch. In the embodiment shown, the plurality of radio frequency bands 106 includes four frequency bands 1, 2, 3, and 4, each operates at a unique frequency band different from other frequency bands in system 100. Such frequency bands can include, but are not limited to CDMA of BC0/1, GSM of band 2/3/5/8, WCDMA of band 1/2/4/5/6/8, LTE of band 1/2/3/4/5/7/8/12/13/17/20/25/26/38/40/41, GPS, Wi-Fi (2.4 GHz and 5 GHz bands), etc. Also note that each frequency band includes at least one bandpass filter, which is typically an LC bandpass filter. In this design, each bandpass filter is spatially separated from other bandpass filters in other frequency band and designed to exclusively operate in the designated frequency band.

Figure 2B:
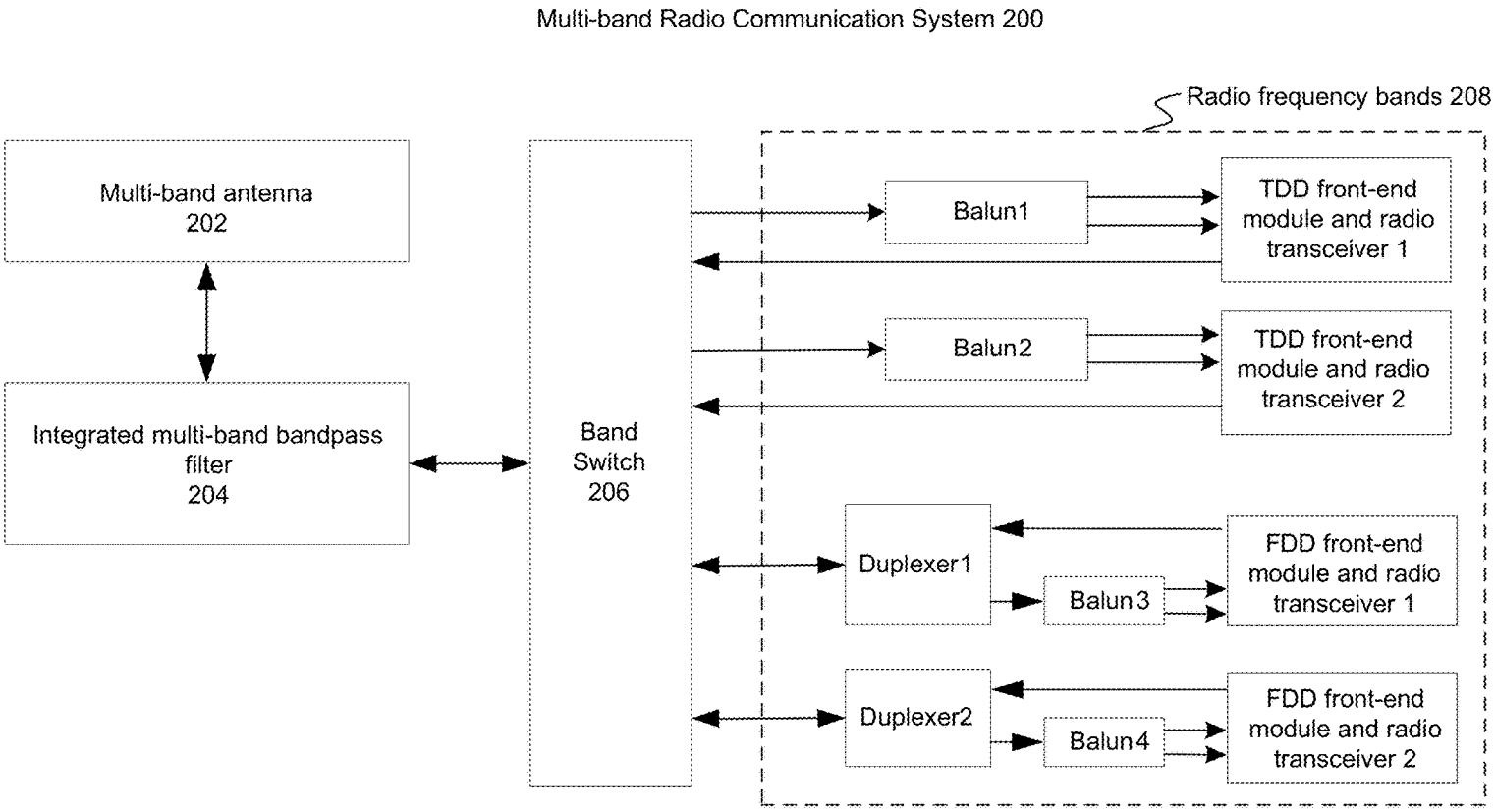
FIG. 2B illustrates a block diagram of an exemplary multi-band radio communication system using an integrated multi-band bandpass filter based on multiple ring dielectric resonators.

Various embodiments of the disclosed technology provide an integrated multi-band bandpass filter based on a set of concentric ring resonators in place of multiple single-band bandpass filters in a multi-band radio system, such as system 100. FIG. 2B illustrates a block diagram of an exemplary multi-band radio communication system using an integrated multi-band bandpass filter based on multiple ring resonators in a filter configuration as shown in FIG. 1. As can be seen in FIG. 2B, multi-band radio communication system 200 includes a multi-band antenna 202, an integrated multi-band bandpass filter (or "multi-band bandpass filter") 204, a band switch 206, and a plurality of radio frequency bands 208. Multi-band antenna 202 is configured to transmit and receive multi-band RF signals. Integrated multi-band bandpass filter 204, which includes a set of collocated (e.g., located concentrically) ring resonators of multiple resonant frequencies corresponding to multiple desired frequency bands, is coupled between multi-band antenna 202 and band switch 206. Hence, multi-band bandpass filter 204 receives the multi-band RF signals as input and generates filtered multi-band outputs according to the bandpass characteristics of the multiple ring resonators. Because integrated multi-band bandpass filter 204 combines the operations of multiple signal bandpass filters, multi-band bandpass filter 204 can simultaneously select and output multiple desired bands of RF signals in accordance with frequency responses of the multiple ring resonators.

Band switch 206 is coupled between multi-band bandpass filter 204 and the plurality of radio frequency bands 208 and operable to connect the outputs of the multi-band bandpass filter 204 to one of the radio frequency bands 208. In one embodiment, band switch 206 is a TDD switch which operates to couple the outputs of the multi-band bandpass filter 204 to one of the RF bands 208 at a given time. In the embodiment shown, radio frequency bands 208 include four radio frequency bands 1, 2, 3, and 4, each operates at a desired frequency band different from other frequency bands. Hence, when a given RF band (e.g., band 1) receives the input signal from band switch 206 which includes multiple selected RF bands, the circuits (e.g., Baluns, front-end modules, radio transceivers) in given RF band will only respond the selected RF band corresponding to the designated frequency band of the given RF band.

In the design of system 200, the multiple single-bandpass filters used in system 100 in FIG. 2A are combined into an integrated multi-band bandpass filter 204 and separated from the circuits of the multiple RF bands 208. In some embodiments, multi-band bandpass filter 204 is implemented as a co-planed ring resonators such that smaller size ring resonators are enclosed by larger size ring resonators, and each ring resonator is designated to one of the desired frequency bands. Although four frequency bands are shown in system 200, other RF communication systems of disclosed technique can have more or fewer than four RF bands.

Compared to the multi-band radio design described in FIG. 2A based on multiple single-bandpass filters, the multi-band radio design described in FIG. 2B can save the real estate in the PCB and reduce the cost of bill of materials. In some embodiments, multi-band bandpass filter 204 is implemented with dielectric ring resonators to provide high rejection to the out-of-band spurious emission and interference due to the high Q characteristics of the dielectric material, thereby outputting selected signals having steep out-of-resonance roll off.

Various exemplary implementations of multi-band bandpass filter 204 are now described in conjunction with FIGS. 3-13 based on the filter configuration in FIG. 1.

Figure 3A:
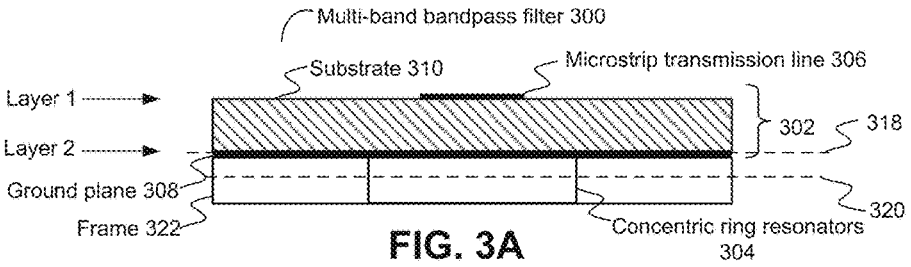
FIG. 3A illustrates a cross-sectional view of an exemplary multi-band bandpass filter based on concentric ring resonators and using a slot-coupling mechanism.
Figure 3B:
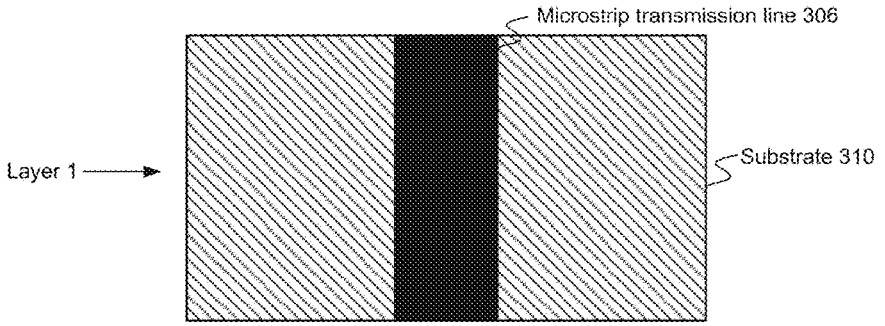
FIG. 3B illustrates a cross-sectional view of the transmission line structure (layer 1), wherein the microstrip transmission line is disposed on the substrate.
Figure 3C:
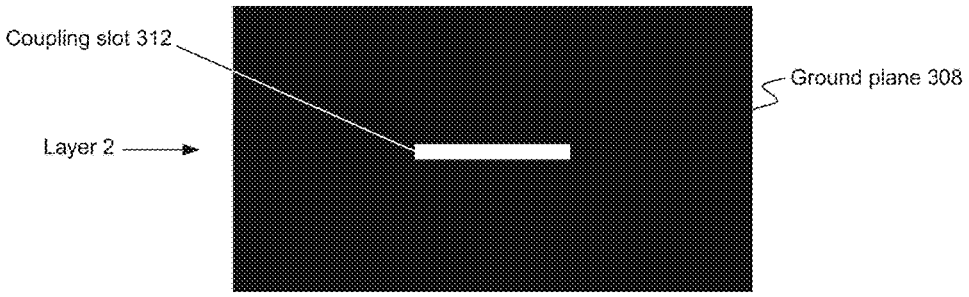
FIG. 3C illustrates a cross-sectional view of an exemplary ground plane (layer 2) including a coupling slot with the cross-section passing through a horizontal plane.

FIGS. 3A, 3B, 3C and 3D show an exemplary integrated multi-band bandpass filter 300 comprising concentric ring resonators and using a slot-coupling mechanism to couple the electromagnetic signals. More specifically, FIG. 3A illustrates a cross-sectional view of the exemplary multi-band bandpass filter 300. The multi-band bandpass filter 300 includes a transmission line structure 302 for guiding electromagnetic signals and acts as or corresponds to both the input and output conductive lines in FIG. 1. Transmission line structure 302 further includes a first conductive layer configured as a microstrip transmission line 306, a second conductive layer configured as a ground plane 308, and a substrate 310 sandwiched between the first conductive layer and the second conductive layer. In this embodiment, a set of concentric ring resonators 304 is provided for filtering electromagnetic signals. The concentric ring resonators 304 are positioned on the ground plane 308. FIG. 3B illustrates a cross-sectional view of the transmission line structure 302 (layer 1), wherein microstrip transmission line 306 is disposed on the substrate 310. FIG. 3C illustrates a top view of ground plane 308 (layer 2), with the cross-section passing through a horizontal plane 318. As can be seen, the conductive layer 2 that forms the ground plane also includes a coupling slot 312 formed in the ground plane, e.g., by chemical etching or mechanical cutting. The coupling slot 312 is a structure that disturbs the electromagnetic field of each signal to cause energy coupling with the dielectric ring resonators 304. While coupling slot 312 is shown to have a rectangular shape, other embodiments can use coupling slot of other geometries, such a bow-tie shape or other non-rectangular shapes. In addition, other structures can be used to perform the coupling function of the coupling slots 312, such as electrode protrusions or other structures capable of disturbing the guided energy in the transmission line structure 302.

Figure 3D:
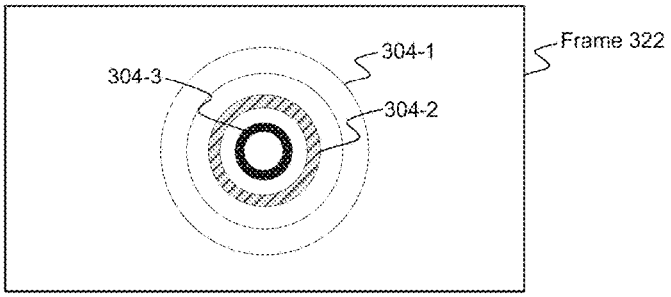
FIG. 3D illustrates a cross-sectional view of exemplary concentric ring resonators with the cross-section passing through a horizontal plane.

FIG. 3D illustrates a cross-sectional view of exemplary concentric ring resonators 304 with the cross-section passing through a horizontal plane 320. In this example, three ring resonators are shown: the outer ring resonator 304-1, the middle ring resonator 304-2, and the inner ring resonator 304-3. In some embodiments, the outer ring resonator 304-1 has the lowest resonant frequency, while the inner ring resonator 304-3 has the highest resonant frequency. Furthermore, these ring resonators can be made of dielectric materials (i.e., dielectric ring resonators) to achieve high Q properties. Note that the three ring resonators 304 have the same geometry center axis, i.e., they are concentrically placed. In the concentric arrangement shown in FIGS. 3A-3D, the multiple bands of desired signals can be simultaneously excited and subsequently selected through the same shared coupling slot, such as coupling slot 312. In implementations, the three ring resonators 304-1, 304-2 and 304-3 are formed of dielectric materials with a refractive index at the signal frequencies higher than the surrounding materials to form an RF waveguide that spatially confines the signals. The dielectric materials between three ring resonators 304-1, 304-2 and 304-3 are dielectric materials with lower refractive indices.

FIG. 3D also shows an assembling frame 322 (also shown in FIG. 3A) surrounding and possibly enclosing concentric ring resonators 304 and placed on the ground plane 308. Assembling frame 322 is included in the integrated multi-band bandpass filter for protection and for the convenience of handling and assembling of ring resonators 304 with other portions of multi-band bandpass filter 300, as ring resonators 304 can be difficult to manipulate by itself due to the typically small dimensions. Assembling frame 322 may be made of an dielectric material having low dielectric constant. In some embodiments, assembling frame 322 is optional.

In multi-band bandpass filter 300, the RF signals can be electromagnetically coupled between the ring resonators 304 and the transmission line 306 through coupling slot 312 in both directions. In some embodiments, when multi-band bandpass filter 300 is used as multi-band bandpass filter 204 in system 200, multi-band RF signals are first coupled into microstrip transmission line 306. The multi-band RF signals are then coupled from transmission line 306 to ring resonators 304 through coupling slot 312. The multiple ring resonators 304 then filter the input signals and simultaneously generate multiple bands of filtered outputs according to the resonant frequencies of the multiple ring resonators. These generated multiple bands of filtered outputs are then coupled from ring resonators 304 back to transmission line 306 through coupling slot 312, and get transmitted either downstream to the band switch 206 or upstream to multi-band antenna 202. The electric field transmitting across coupling slot 312 ensures the coupling between the RF signals in the transmission line 306 and the RF signals in the ring resonator elements.

Figure 4:
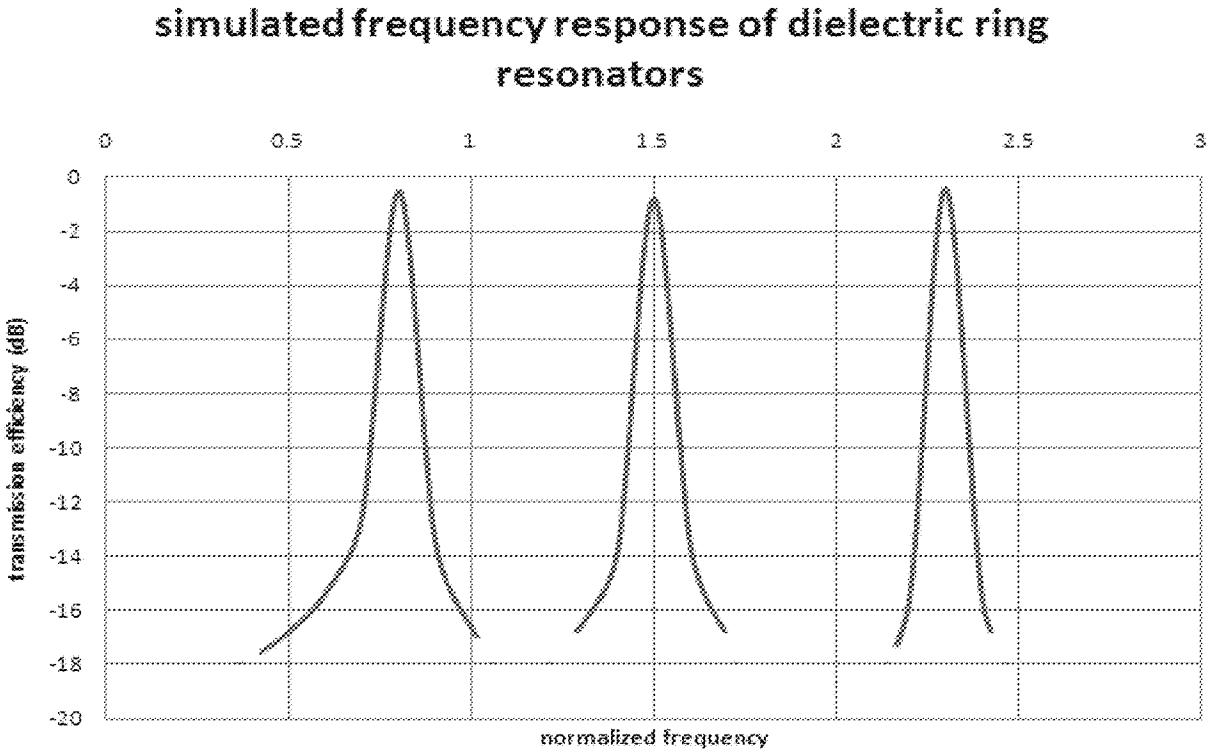
FIG. 4 illustrates an exemplary frequency-dependency plot of the ring resonators within an integrated multi-band bandpass filter.

The coupling between the transmission line or "the trace" and the ring resonators are generally frequency-dependent. In one embodiment, the transmission efficiency of the coupling structure (e.g., coupling slot 312) can be defined as the ratio of output power to the input power of the transmission line (e.g., transmission line 306). Based on this definition, FIG. 4 illustrates an exemplary frequency-dependency plot of the ring resonators within an integrated multi-band bandpass filter. Because each of the ring resonators is designed to have a different resonant frequency, multi-band bandpass characteristics can be achieved. Note the steep out-of-resonance roll off in each individual frequency response which is due to using dielectric material to achieve very high Q.

In some exemplary designs, the substrate in the multi-band bandpass filter has a thickness in the order of 50 μm and the ring resonators are made of extremely low loss dielectric materials. For example, the loss of the dielectric material can be in the order of 0.0001, while the dielectric permittivity can be in the order of 1000. Using such designs, the coupling between the transmission line and the dielectric ring resonators can be very strong which results in extreme low insertion loss in the overall filter structure. Attributing to the high permittivity of the dielectric material, the Q factor of the dielectric ring resonators can also be very high (e.g., in the order of 5000), and hence the rejection of spurious emission or interference at out-of-band frequencies (i.e., at frequencies outside of the resonant-frequencies) can be very high.

Figure 5:
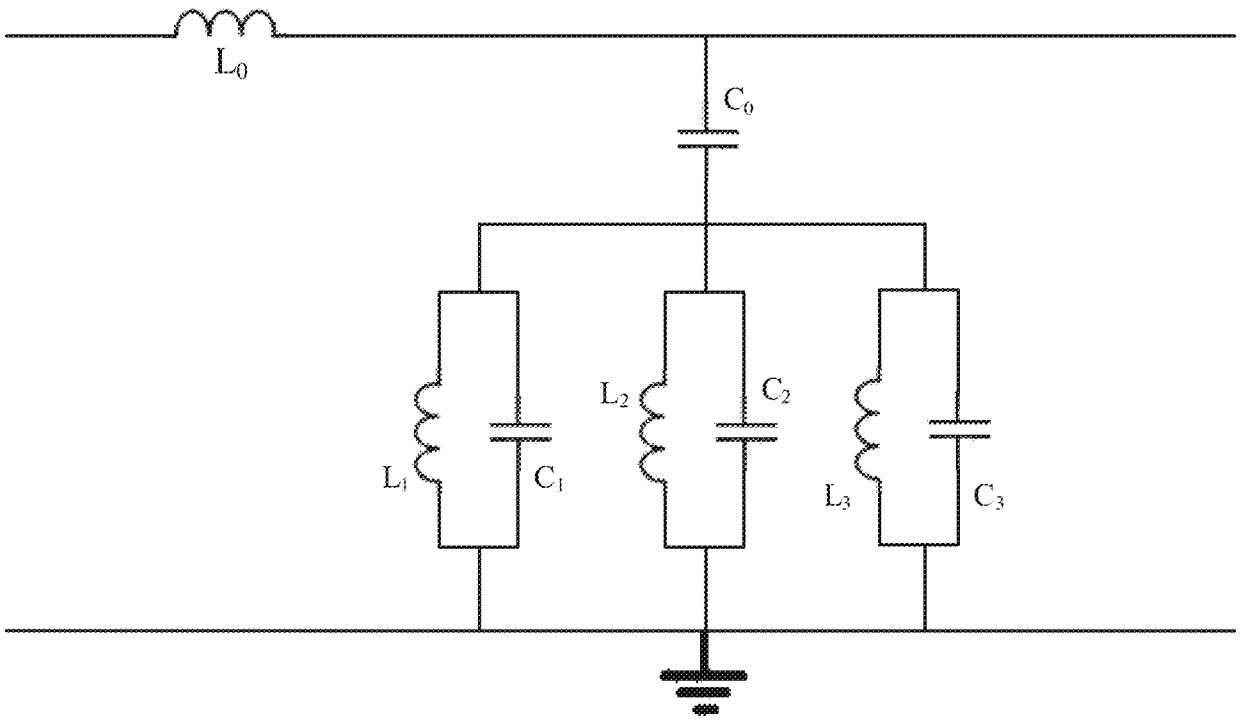
FIG. 5 shows an exemplary equivalent circuit of an integrated multi-band bandpass filter.

FIG. 5 shows an exemplary equivalent circuit of the multi-band bandpass filter 300 illustrated in FIG. 3. In FIG. 5, $L_0$ and $C_0$ represent the equivalent inductance and capacitance of the transmission line structure 302, $L_1$ and $C_1$ represent the equivalent inductance and capacitance of the outer ring resonator 304-1, $L_2$ and $C_2$ represent the equivalent inductance and capacitance of the middle ring resonator 304-2, and $L_3$ and $C_3$ represent the equivalent inductance and capacitance of the inner ring resonator 304-3. Furthermore, $L_1$ and $C_1$ correspond to frequency $f_1$, the central frequency of the first desired signal band; $L_2$ and $C_2$ correspond to frequency $f_2$, the central frequency of the second desired signal band; and $L_3$ and $C_3$ correspond to frequency $f_3$, the central frequency of the third desired signal band ($f_1<f_2<f_3$). In some embodiments, the frequencies can be computed using the following equation:

$$f_i=1/(2\pi\sqrt{L_iC_i}),\ \text{where } i=1,2,3.$$

Figure 6:
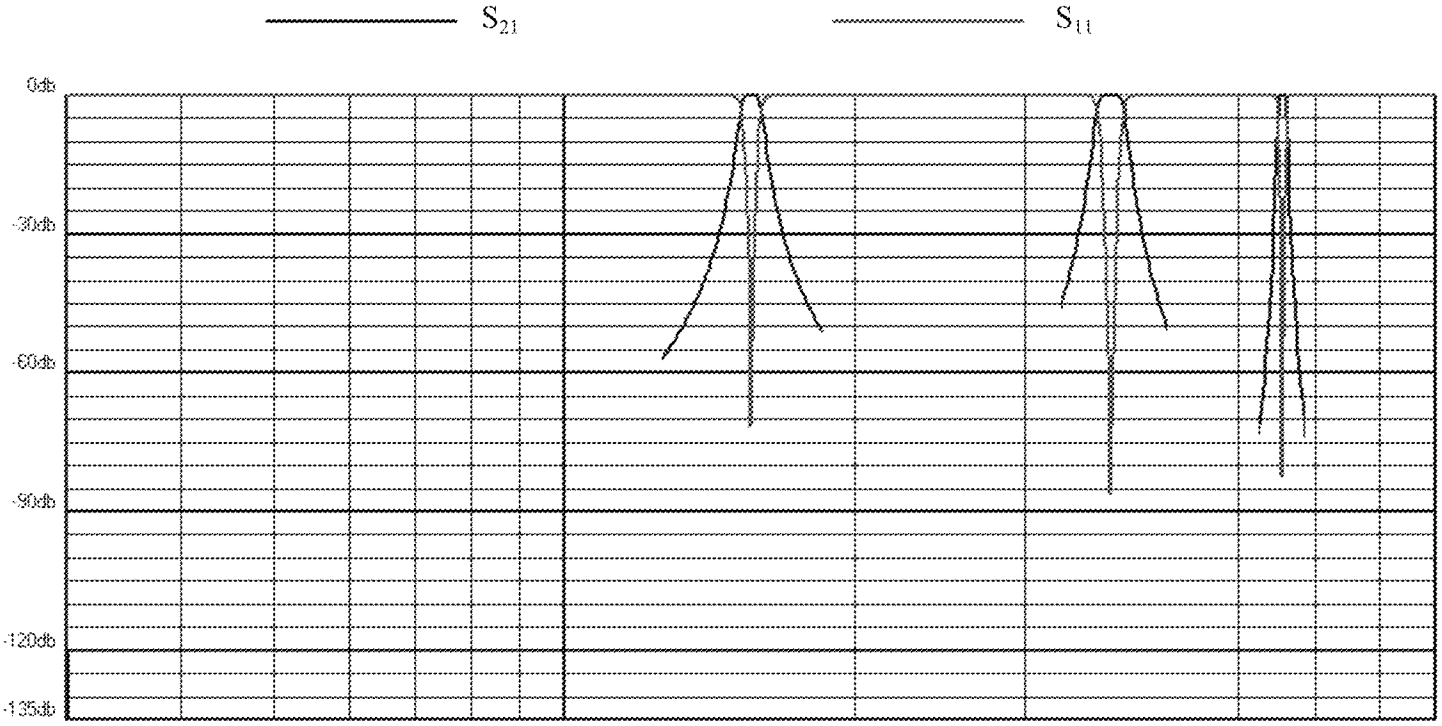
FIG. 6 illustrates an exemplary plot of RF transmission characteristics of an embodiment of the integrated multi-band bandpass filter.

FIG. 6 illustrates an exemplary plot of RF transmission characteristics of an embodiment of the integrated multi-band bandpass filter 300. As described above in conjunction with FIG. 3, the multi-band bandpass filter used to perform this test comprises a transmission line coupled to three concentric ring resonators positioned on the ground plane wherein the coupling is facilitated by a coupling slot in the ground plane. Moreover, the ring resonators are dielectric ring resonators. The transmission plot of FIG. 6 shows that the RF signals only transmit at three desired RF frequency bands corresponding to the three dielectric ring resonators with less than 0.3 dB insertion loss, and would be greatly attenuated at unwanted frequencies.

Figure 7A:
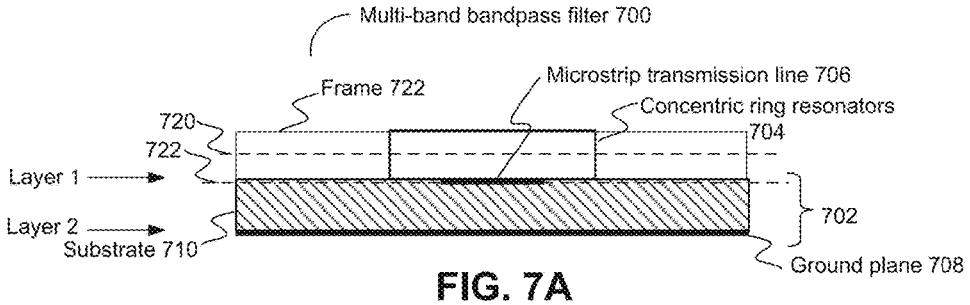
FIG. 7A illustrates a cross-sectional view of the exemplary multi-band bandpass filter based on direct-coupling between the concentric ring resonators and the transmission line.
Figure 7B:
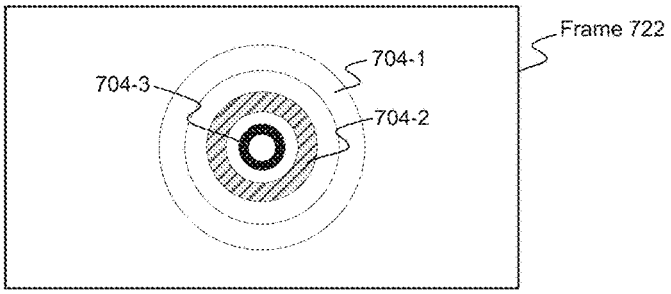
FIG. 7B illustrates a cross-sectional view of the exemplary concentric ring resonators with the cross-section passing through a horizontal plane.

FIGS. 7A, 7B, 7C and 7D show an exemplary multi-band bandpass filter 700 having a direct-coupling configuration between the concentric ring resonators and the transmission line structure. As can be seen in FIGS. 7A and 7B, the concentric ring resonators are positioned directed over the transmission line structure 702. More specifically, FIG. 7A illustrates a cross-sectional view of the exemplary multi-band bandpass filter 700. As can be seen, multi-band bandpass filter 700 includes a transmission line structure 702 for guiding electromagnetic signals and a set of concentric ring resonators 704 for filtering electromagnetic signals. Transmission line structure 702 further includes a first conductive layer configured as a microstrip transmission line 706, a second conductive layer configured as a ground plane 708, and a substrate 710 sandwiched between the first conductive layer and the second conductive layer. In this embodiment, concentric ring resonators 704 are positioned on the transmission line 706 side of transmission line structure 702, for example, by making direct contact with transmission line 706.

FIG. 7B illustrates a cross-sectional view of exemplary concentric ring resonators 704 with the cross-section passing through a horizontal plane 720. In this example, three ring resonators are shown: the outer ring resonator 704-1, the middle ring resonator 704-2, and the inner ring resonator 704-3. In some embodiments, the outer ring resonator 704-1 has the lowest resonant frequency, while the inner ring resonator 704-3 has the highest resonant frequency. Furthermore, these ring resonators can be made of dielectric materials (i.e., dielectric ring resonators). FIG. 3B also shows an assembling frame 722 (also shown in FIG. 7A) surrounding concentric ring resonators 704 for the convenience of handling and assembling of ring resonators 704 with other portions of multi-band bandpass filter 700. Assembling frame 722 may be made of an dielectric material having low dielectric constant. In some embodiments, assembling frame 722 is optional.

Figure 7C:
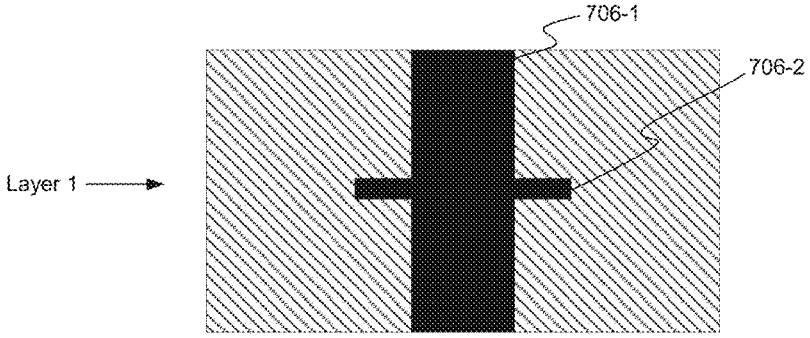
FIG. 7C illustrates a cross-sectional view of the transmission line structure with the cross-section passing through a horizontal plane.
Figure 7D:
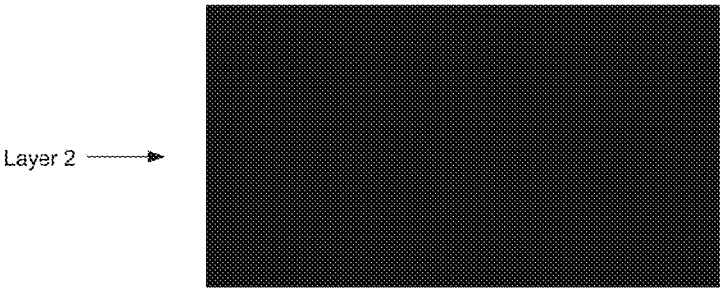
FIG. 7D illustrates a cross-sectional view of the ground plane.

FIG. 7C illustrates a cross-sectional view of transmission line structure 702 (layer 1) with the cross-section passing through a horizontal plane 722, wherein microstrip transmission line 706 is disposed on the substrate 710. As can be seen in FIG. 7C, microstrip transmission line 706 includes both a microstrip 706-1 and coupling strip 706-2 oriented perpendicular to the microstrip 706-1. In this configuration, the RF signals can be directly coupled into the ring resonators 704 through the electromagnetic fields generated around coupling stub 706-2 of the transmission line 706. More specifically, electromagnetic fields can be excited in the proximity of coupling stub 706-2 and coupled to ring resonators 704 operable as multiple bandpass filters. In some embodiments, additionally matching stub or surface mounted components (e.g., capacitors, inductors) may be used to improve impedance matching performance, thereby enhancing coupling. FIG. 7D illustrates a cross-sectional view of the ground plane 708 (layer 2). As can be seen, ground plane 708 made of a conductive layer does not include a coupling slot.

Figure 8A:
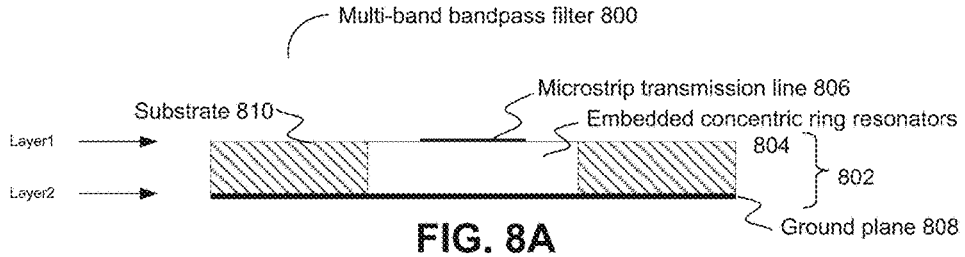
FIG. 8A illustrates a cross-sectional view of the exemplary multi-band bandpass filter wherein the concentric ring resonators are embedded in the substrate.
Figure 8B:
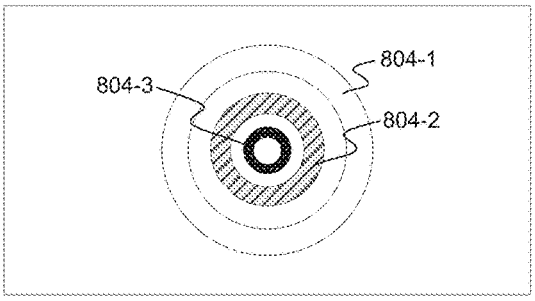
FIG. 8B illustrates a cross-sectional view of the exemplary concentric ring resonators.

FIGS. 8A, 8B, 8C and 8D show an exemplary multi-band bandpass filter 800 wherein the concentric ring resonators are embedded in the substrate of the transmission line structure. As can be seen in FIGS. 8A and 8B, the concentric ring resonators are positioned between the transmission line and the ground plane inside the substrate of the transmission line structure 802. More specifically, FIG. 8A illustrates a cross-sectional view of the exemplary multi-band bandpass filter 800. As can be seen, multi-band bandpass filter 800 includes a transmission line structure 802 for guiding electromagnetic signals and a set of concentric ring resonators 804 for filtering electromagnetic signals. Transmission line structure 802 further includes a first conductive layer configured as a microstrip transmission line 806, a second conductive layer configured as a ground plane 808, and a substrate 810 sandwiched between the first conductive layer and the second conductive layer. In this embodiment, concentric ring resonators 804 are positioned inside substrate 810 in between transmission line 806 and ground plane 808. Hence, the embedded concentric ring resonators can make direct contact with transmission line 806.

Figure 8C:
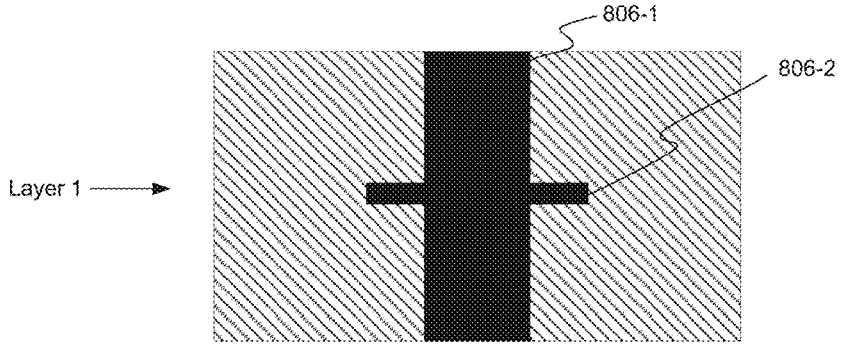
FIG. 8C illustrates a cross-sectional view of the transmission line structure with the cross-section passing through a horizontal plane.
Figure 8D:
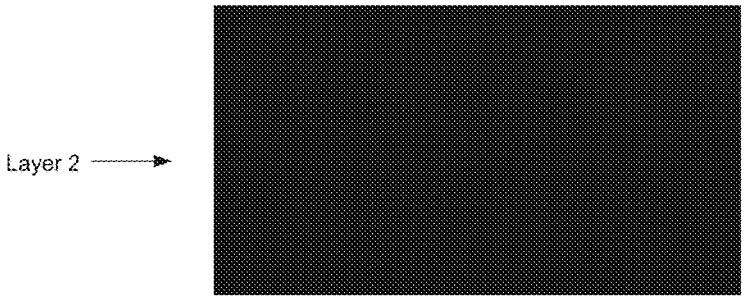
FIG. 8D illustrates a cross-sectional view of the ground plane.

FIG. 8B illustrates a cross-sectional view of exemplary concentric ring resonators 804 which is substantially the same as concentric ring resonators 704 shown in FIG. 7B. FIG. 8C illustrates a cross-sectional view of transmission line structure 802 (layer 1) which is substantially the same as transmission line structure 702 shown in FIG. 7C. In this configuration, the RF signals can be directly coupled into the ring resonators 804 through the electromagnetic fields generated around coupling stub 806-2 of the transmission line 806. More specifically, electromagnetic fields can be excited in the proximity of coupling stub 806-2 and coupled to the ring resonators operable as multiple bandpass filters. In some embodiments, additionally matching stub or surface mounted components (e.g., capacitors, inductors) may be used to improve impedance matching performance, thereby enhancing coupling. FIG. 8D illustrates a cross-sectional view of the ground plane 808 (layer 2). As can be seen, the conductive layer does not include a coupling slot.

Referring back to FIGS. 2A and 2B, and as disclosed above, communication system 200 in FIG. 2A-2B, which can be a multi-band multi-radio smartphone, a mobile phone, a portable tablet computer, a portable laptop computer, a GPS device, or a Wi-Fi device, provides an exemplary application of the disclosed integrated multi-band bandpass filter design, wherein the integrated multi-band bandpass filter 204 is incorporated between the multi-band antenna 202 and the band switch 206 (e.g., a single-pull multi-throw switch). Multi-band bandpass filter 204 is operable to attenuate the unwanted noises in both transmission and receiving paths, and does not introduce significant insertion loss for the desired signals in the transmission and receiving paths. Compared to the multi-band radio design described in FIG. 1 based on multiple single-bandpass filters, the multi-band radio design described in FIG. 2A and FIG. 2B can save the real estate in the PCB and reduce the cost of bill of materials.

To further improve the RF performance of the multi-band bandpass characteristics of the disclosed filter based on the concentric ring resonators, the width of the transmission line in the transmission line structure (e.g., the transmission lines 306, 706, 806) can be made non-uniform, and the coupling slot (e.g., coupling slot 312) can have non-rectangular shapes, e.g., a bow-tie shape or other non-rectangular shapes.

Figure 9A:
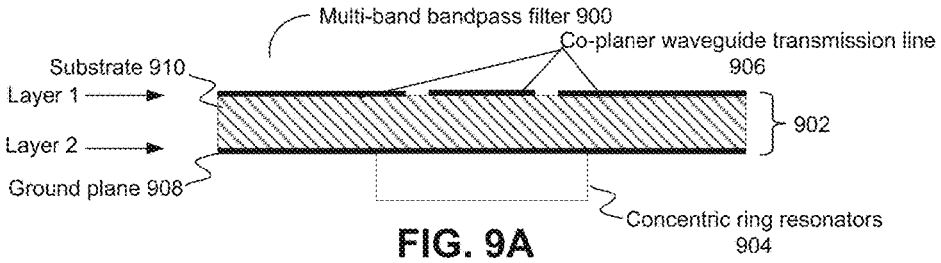
FIG. 9A illustrates a cross-sectional view of an exemplary multi-band bandpass filter comprising concentric ring resonators and a co-planar waveguide transmission line.
Figure 9B:
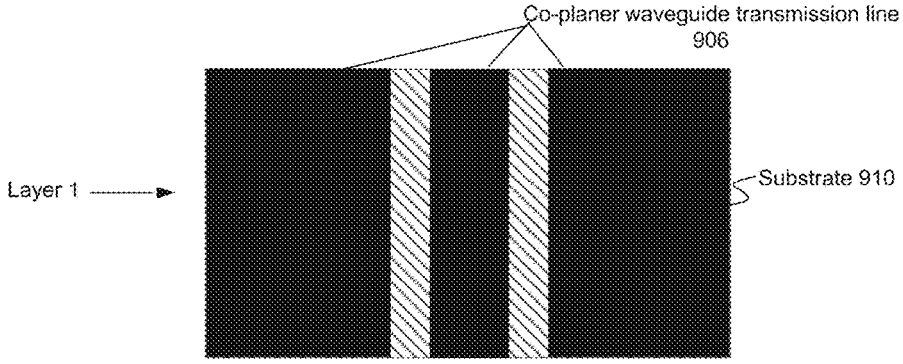
FIG. 9B illustrates a cross-sectional view of the co-planar waveguide transmission line structure.
Figure 9C:
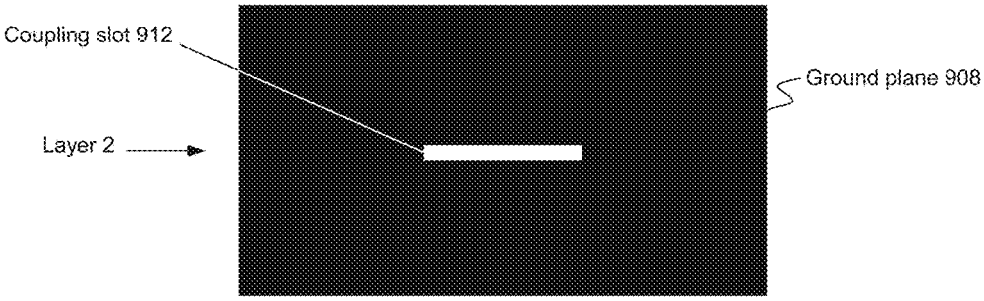
FIG. 9C illustrates a cross-sectional view of ground plane with a formed coupling slot.
Figure 9D:
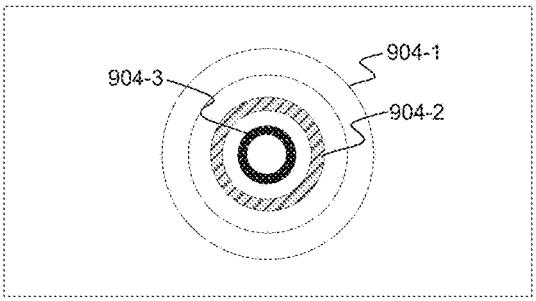
FIG. 9D illustrates a cross-sectional view of the exemplary concentric ring resonators.

While exemplary designs of the disclosed multi-band bandpass filters illustrated in FIGS. 3A to 3D, 7A to 7D, and 8A to 8D use standard microstrip transmission lines in the transmission line structure, other variations of the transmission line structure can also be used. FIG. 9 shows an exemplary multi-band bandpass filter 900 comprising ring resonators and a co-planar waveguide transmission line. Compared to multi-band bandpass filter 300 in FIG. 3A-3B, we note that these multi-band bandpass filters are substantially the same except that that the microstrip transmission line 306 is replaced with a co-planar waveguide transmission line 906. FIG. 9A illustrates a cross-sectional view of the exemplary multi-band bandpass filter 900. FIG. 9B illustrates a cross-sectional view of the transmission line structure (layer 1), wherein a co-planar waveguide transmission line 906 is disposed on the substrate 910. FIG. 9C illustrates a cross-sectional view of ground plane 908 (layer 2) with a formed coupling slot 912. FIG. 9D illustrates a cross-sectional view of exemplary concentric ring resonators 904.

FIG. 10 shows an exemplary multi-band bandpass filter 1000 comprising dielectric ring resonators and a stripline transmission line. Compared to multi-band bandpass filter 300 in FIG. 3A, we note that these multi-band bandpass filters are substantially the same except that that the microstrip-based transmission line structure 302 is replaced with a stripline-based transmission line structure 1002. FIG. 10A illustrates a cross-sectional view of the exemplary multi-band bandpass filter 1000. As can be seen, transmission line structure 1002 further includes a first conductive layer configured as a first ground plane 1008, a conductive layer configured as a stripline 1006, a second conductive layer configured as a second ground plane 1018, and a first substrate 1010 sandwiched between the first ground plane 1008 and stripline 1006, and a second substrate 1020 sandwiched between the second ground plane 1018 and stripline 1006. In the embodiment shown, stripline 1006 is positioned half way between the first ground plane and the second ground plane, and embedded between the first and second substrates. Furthermore, concentric ring resonators 1004 are positioned on the second ground plane 1018.

Figure 10A:
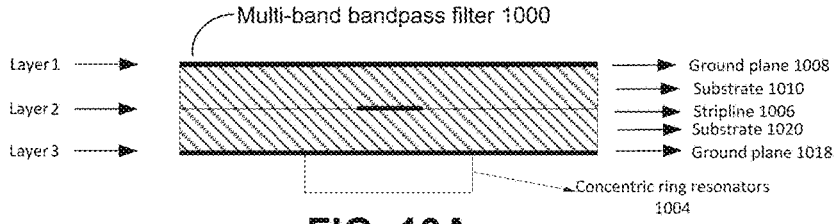
FIG. 10A illustrates a cross-sectional view of the exemplary multi-band bandpass filter comprising concentric ring resonators and a stripline transmission line.
Figure 10B:
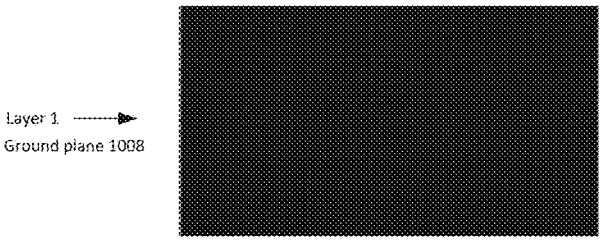
FIG. 10B illustrates a cross-sectional view of the first ground plane (layer 1).
Figure 10C:
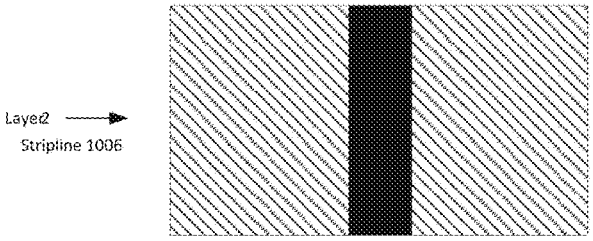
FIG. 10C illustrates a cross-sectional view of the stripline over the substrate (layer 2).
Figure 10D:
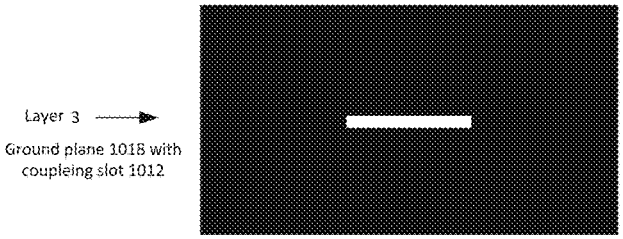
FIG. 10D illustrates a cross-sectional view of the second ground plane (layer 3) with a formed coupling slot.
Figure 10E:
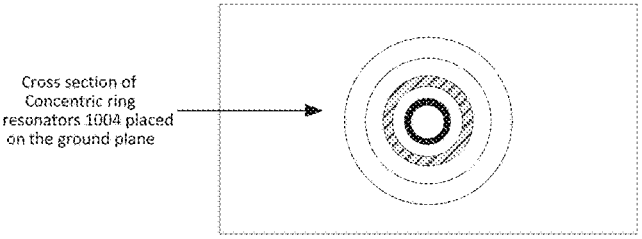
FIG. 10E illustrates a cross-sectional view of the exemplary concentric ring resonators.

FIG. 10B illustrates a cross-sectional view of the first ground plane 1008 (layer 1). FIG. 10C illustrates a cross-sectional view of the stripline 1006 over the substrate. FIG. 10D illustrates a cross-sectional view of the second ground plane 1018 (layer 3) with a formed coupling slot 1012. FIG. 10E illustrates a cross-sectional view of exemplary concentric ring resonators 1004. Note that although only slot-coupling embodiments are illustrated in association with the multi-band bandpass filter 900 based on the co-planar waveguide transmission line and multi-band bandpass filter 1000 based on the stripline transmission line, the direct-coupling and embedded-coupling embodiments described in conjunction with multi-band bandpass filters 700 and 800 can also be implemented in multi-band bandpass filters 900 and 1000.

Referring back to FIGS. 3D, 7B, 8B and 9D, each illustrated dielectric ring resonator in those examples is used for filtering a specific frequency band. The center frequency of the resonator resonance and the spectral shape and width of the resonator resonance are determined by the materials and geometry of the ring resonator and its surroundings. In some applications, the requirements on the center frequency of the resonator resonance and the spectral shape and width of the resonator resonance may be difficult to achieve with a single dielectric resonator. It is possible, however, to use two or more dielectric resonators with similar resonator resonances together to cause coupling between such resonators so that the coupling between such resonators can produce a filter spectral profile with a desired center frequency, a desired spectral shape and a desired spectral width that would otherwise be difficult to achieve with a single resonator. For example, a high Q dielectric resonator is desirable to suppress noise and provide effective filtering but it inherently has a narrow spectral width that may not be suitable when a certain bandwidth is needed. Therefore, for each frequency band, two or more coupled dielectric resonators with similar resonator resonances may be used to construct a composite resonator for a particular frequency band to achieve the desired bandwidth and other spectral properties in filtering operation at that frequency band.

Figure 11:
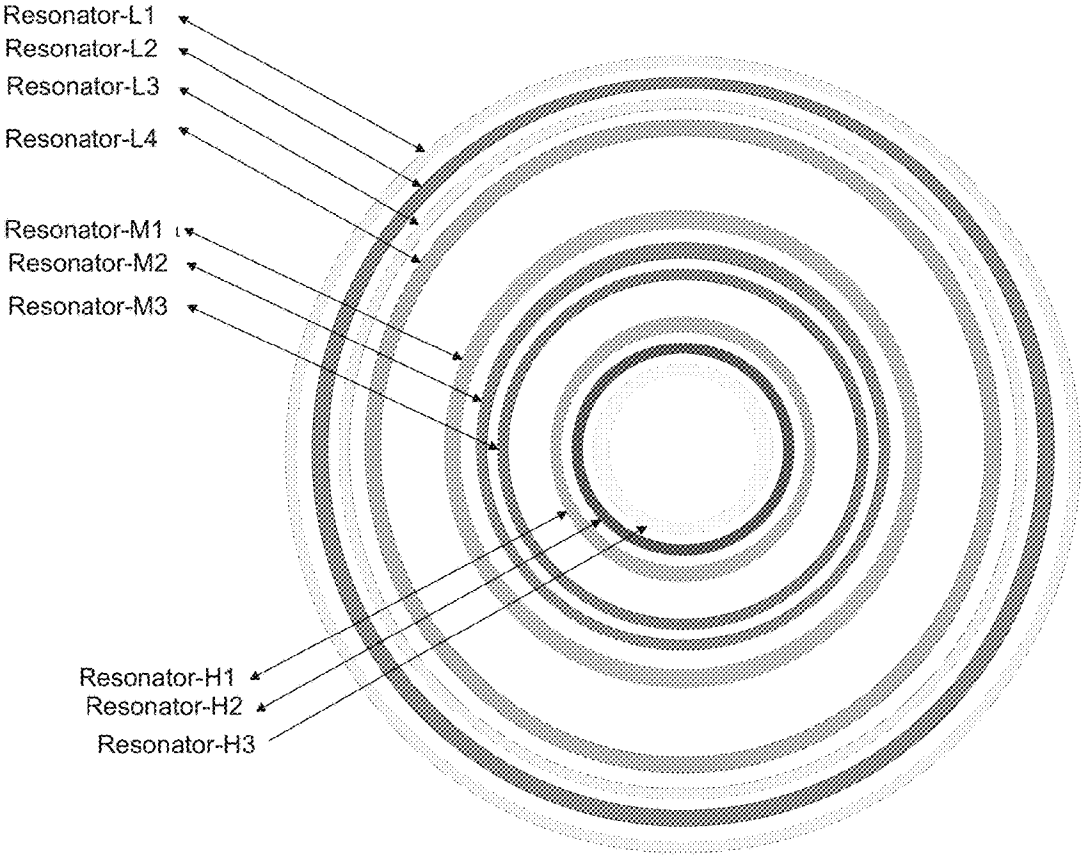
FIG. 11 illustrates a cross-sectional view of an exemplary arrangement of a plurality of concentric ring resonators to extend the operation bandwidth of each passband.

FIG. 11 illustrates a cross-sectional view of an exemplary arrangement of a plurality of concentric ring resonators to extend the operation bandwidth of each passband. In this example, the resonant frequencies of the multiple ring resonators in each passband are slightly separated from each other so that these resonators in a given passband produce an overall bandpass having desired and wider operating bandwidth. As shown in FIG. 11, a first group of concentric ring resonators (L1, L2, L3, L4) having similar but slightly different sizes are designed to form a first composite resonator with a low-frequency band, referred to as "band L"; a second group of concentric ring resonators (M1, M2, M3) having similar but slightly different sizes are designed to form a second composite resonator with a middle-frequency band, referred to as "band M"; and a third group of concentric ring resonators (H1, H2, H3) having similar but slightly different sizes are designed to form a third composite resonator with a high-frequency band, referred to as "band H". For each composite resonator, the concentric ring resonators are formed of a dielectric material with a refractive index higher than the gaps between the concentric ring resonators.

Figure 12:
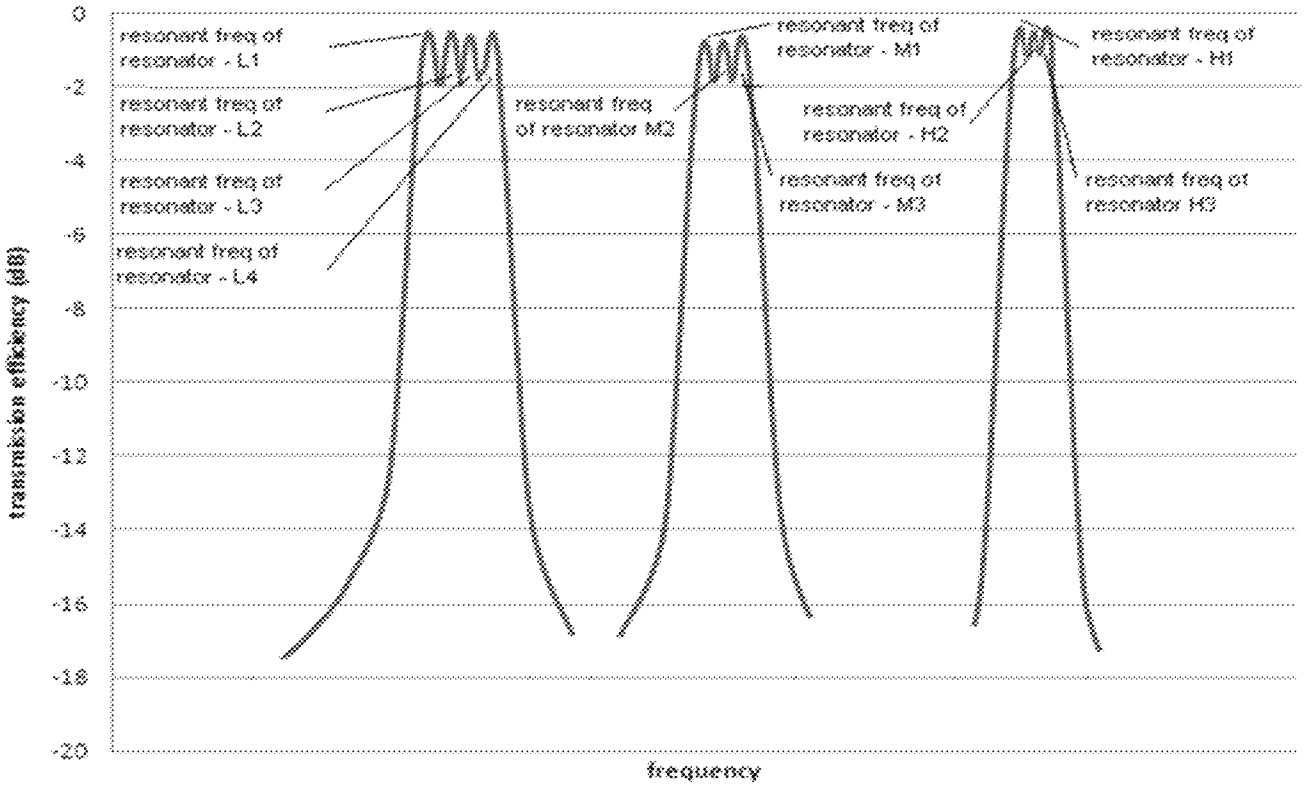
FIG. 12 illustrates a plot of exemplary transmission characteristics of the plurality of the dielectric ring resonators illustrated in FIG. 11.
Figure 13A:
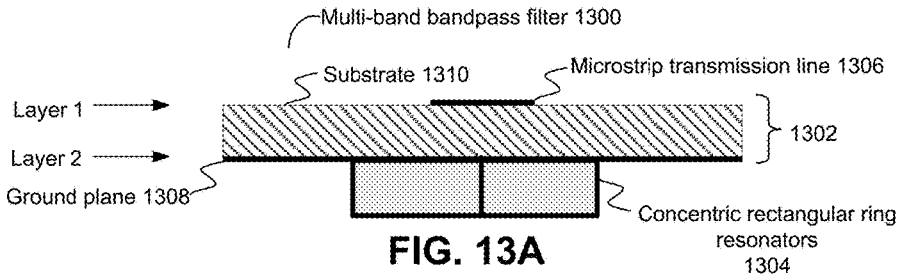
FIG. 13A shows across-sectional view of the exemplary multi-band bandpass filter comprising concentric rectangular ring resonators and using a slot-coupling mechanism.
Figure 13B:
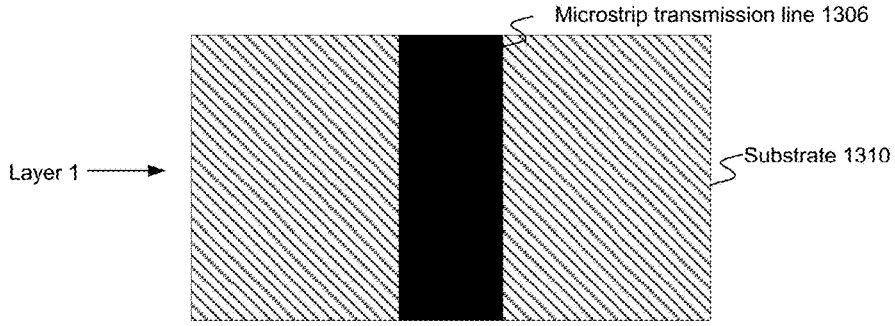
FIG. 13B illustrates a cross-sectional view of the transmission line structure (layer 1), wherein the microstrip transmission line is disposed on the substrate.
Figure 13C:
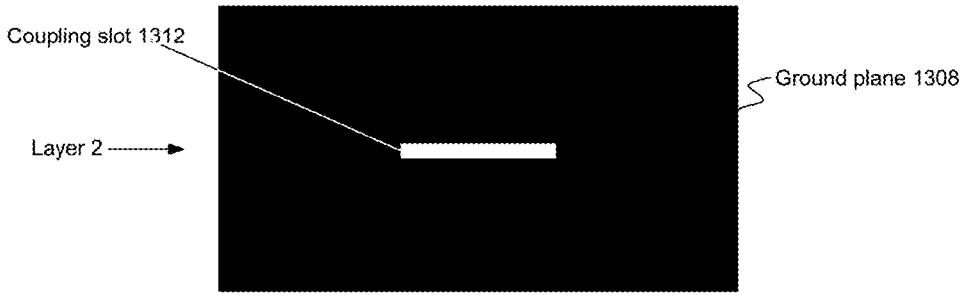
FIG. 13C illustrates a cross-sectional view of an exemplary ground plane (layer 2) including a coupling slot with the cross-section passing through a horizontal plane.
Figure 13D:
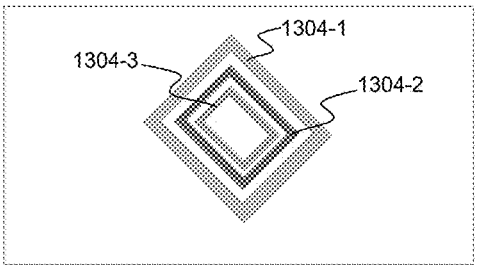
FIG. 13D illustrates a cross-sectional view of exemplary concentric rectangular ring resonators with the cross-section passing through a horizontal plane.

FIG. 12 illustrates a plot of exemplary transmission characteristics of the plurality of the concentric ring resonators illustrated in FIG. 11. More specifically, FIG. 11 shows that the bandwidths of the multi-bandpass filters are extended in each of the operation band (bands L, M, H) by using a plurality of resonator elements with closely spaced but different resonant frequencies. For example, for the band L, the overall bandwidth is the combined bandwidths of individual ring resonators (L1, L2, L3, L4), and for the band M and band H, the overall bandwidths are the combined bandwidths of individual ring resonators (M1, M2, M3), (H1, H2, H3), respectively. Hence, for each of the designed passband, a wider or narrower overall bandwidth can be achieved by including greater or fewer number of ring resonators. To facilitate the assembly of these resonator elements in the practical applications, the interspatial gaps among these resonator elements may be filled with a material having low dielectric constant.

To further extend the operating bandwidth of the concentric ring resonators, two modes of each of the ring resonators may be excited by appropriately aligning the orientation of the coupling area and the ring resonators. FIGS. 13A, 13B, 13C and 13D show an exemplary multi-band bandpass filter 1300 comprising concentric rectangular ring resonators. Compared to multi-band bandpass filter 300 in FIGS. 3A-3D, these multi-band bandpass filters are substantially the same except that that the concentric circular ring resonators 304 are replaced with concentric rectangular ring resonators 1304. For each of the resonators, because the fundamental resonant frequency is determined by one side of the rectangular ring resonator, the given resonator would exhibit two fundamental frequencies, thereby exciting the dual modes in the given resonator. In some embodiments, the concentric rectangular ring resonators 1304 are made of a dielectric material.

Furthermore, the resonant frequency is often shape-dependent. In the case of using circular or elliptical ring resonators, the high-order resonant frequencies of the higher-order modes can be nonlinear functions (e.g., Bessel and Mathieu functions in the circular and elliptical ring structure, respectively) of the resonator dimensions. Hence, by using circular or elliptical resonator elements in an integrated multi-band bandpass filter design, the harmonics of the desired passband can be greatly rejected.

Figure 14:
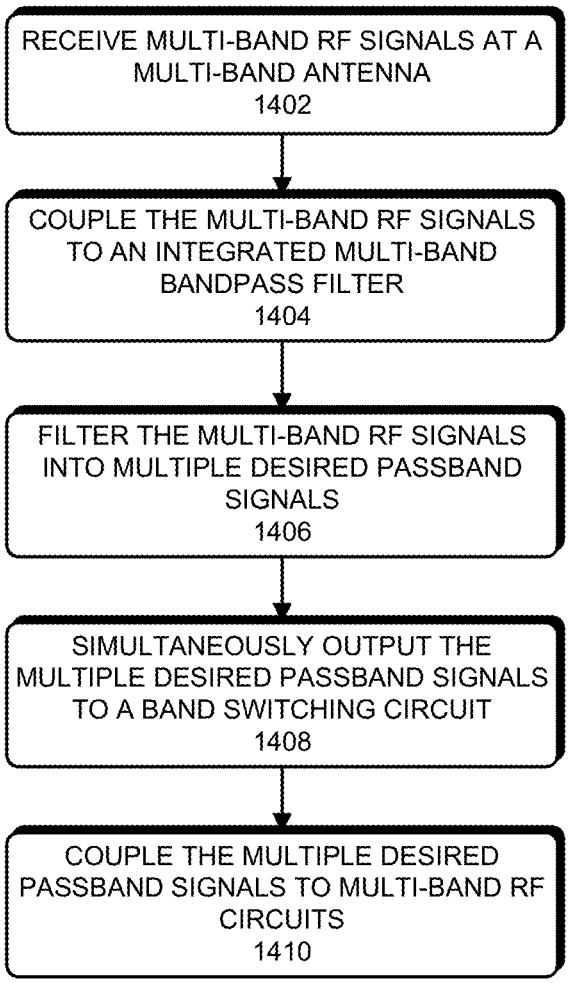
FIG. 14 presents a flowchart illustrating an exemplary process for filtering multi-band RF signals within a multi-band RF communication device.

FIG. 14 presents a flowchart illustrating an exemplary process for filtering multi-band RF signals within a multi-band RF communication device. This process includes receiving multi-band RF signals at a multi-band antenna (1402) and coupling the multi-band RF signals to an integrated multi-band bandpass filter (1404). The integrated multi-band bandpass filter then filters the multi-band RF signals into multiple desired passband signals (1406), and then simultaneously outputs the multiple desired passband signals to a band switching circuit (1408). The band switching circuit then couples the multiple desired passband signals to multi-band RF circuits (1410).

While this patent document contains many specifics, these should not be construed as limitations on the scope of an invention that is claimed or of what may be claimed, but rather as descriptions of features specific to particular embodiments. Certain features that are described in this document in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Only a few examples and implementations are disclosed. Variations, modifications, and enhancements to the described examples and implementations and other implementations can be made based on what is disclosed.

What is claimed is what is disclosed and illustrated, including:

1. An integrated multi-band bandpass filter, comprising:

a transmission line structure for transmitting and receiving multi-band RF signals; and a plurality of ring resonators of different sizes and different resonant frequencies electromagnetically coupled to the transmission line structure to receive the multi-band RF signals, wherein each of the plurality of ring resonators is configured as a bandpass filter for generating a passband signal having a central frequency corresponding to the associated resonant frequency of the ring resonator, and the plurality of ring resonators of different sizes and different resonant frequencies include two or more subgroups of ring resonators, wherein each subgroup of ring resonators includes two or more ring resonators of closely-spaced resonant frequencies, wherein the two or more ring resonators operate as a single wideband bandpass filter having a bandwidth substantially equal to a combined bandwidth of the two or more ring resonators.

2. The integrated multi-band bandpass filter of claim 1, wherein the transmission line structure includes:

a first conductive layer having a signal trace for transmitting and receiving the multi-band RF signals;

a second conductive layer configured as a ground plane; and a dielectric substrate positioned between the first conductive layer and the second conductive layer.

3. The integrated multi-band bandpass filter of claim 1, wherein each of the plurality of ring resonators is a dielectric ring resonator.

4. The integrated multi-band bandpass filter of claim 1, wherein the plurality of ring resonators are coplanar.

5. The integrated multi-band bandpass filter of claim 1, wherein the plurality of ring resonators are concentric.

6. The integrated multi-band bandpass filter of claim 1, wherein the transmission line structure includes one of:

a microstrip transmission line;

a coplanar waveguide transmission line; and a stripline transmission line.

7. The integrated multi-band bandpass filter of claim 1, wherein the at least two subgroups of ring resonators include three subgroups of ring resonators corresponding to a low passband, a medium passband, and a high passband, respectively.

8. The integrated multi-band bandpass filter of claim 1, wherein the plurality of ring resonators are concentric dielectric circular ring resonators, wherein gaps between the two or more ring resonators within each subgroup of ring resonators are filled with a low dielectric constant material.

9. The integrated multi-band bandpass filter of claim 8, wherein the radii of the two or more ring resonators within each subgroup of ring resonators are separated by a difference $\Delta r_1$, wherein the central radii of two adjacent subgroups of ring resonators is separated by a difference $\Delta r_2$, and wherein $\Delta r_1 \ll \Delta r_2$.

10. The integrated multi-band bandpass filter of claim 1, wherein the plurality of ring resonators are circular or elliptical ring resonators.

11. The integrated multi-band bandpass filter of claim 1, wherein the plurality of ring resonators are rectangular ring resonators, wherein each of the rectangular ring resonators has two frequency modes.

12. The integrated multi-band bandpass filter of claim 1, further comprising an assembly frame disposed on the transmission line structure to enclose the plurality of ring resonators to provide a protection structure during handing and assembly of the integrated multi-band bandpass filter.

13. The multi-band bandpass filter of claim 1, wherein the plurality of ring resonators are made of a high Q dielectric material.

14. An integrated multi-band bandpass filter, comprising:

a transmission line structure for transmitting and receiving multi-band RF signals, wherein the transmission line structure includes:

a first conductive layer having a signal trace for transmitting and receiving the multi-band RF signals;

a second conductive layer configured as a ground plane; and a dielectric substrate positioned between the first conductive layer and the second conductive layer; and a plurality of ring resonators of different sizes and different resonant frequencies electromagnetically coupled to the transmission line structure to receive the multi-band RF signals, wherein each of the plurality of ring resonators is configured as a bandpass filter for generating a passband signal having a central frequency corresponding to the associated resonant frequency of the ring resonator, and the plurality of ring resonators are disposed on the second conductive layer and electromagnetically coupled to the signal trace through a coupling slot etched into the second conductive layer.

15. The integrated multi-band bandpass filter of claim 14, wherein the coupling slot can have a rectangular shape, a bowtie shape, and other nonrectangular shapes.

16. An integrated multi-band bandpass filter, comprising:

a transmission line structure for transmitting and receiving multi-band RF signals, wherein the transmission line structure includes:

a first conductive layer having a signal trace for transmitting and receiving the multi-band RF signals;

a second conductive layer configured as a ground plane; and a dielectric substrate positioned between the first conductive layer and the second conductive layer; and a plurality of ring resonators of different sizes and different resonant frequencies electromagnetically coupled to the transmission line structure to receive the multi-band RF signals, wherein each of the plurality of ring resonators is configured as a bandpass filter for generating a passband signal having a central frequency corresponding to the associated resonant frequency of the ring resonator, and the plurality of ring resonators are disposed on the first conductive layer and electromagnetically coupled to the signal trace through direct contact.

17. The integrated multi-band bandpass filter of claim 16, wherein the plurality of ring resonators are electromagnetically coupled to the signal trace additionally through a coupling stub configured as a part of the signal trace.

18. An integrated multi-band bandpass filter, comprising:

a transmission line structure for transmitting and receiving multi-band RF signals, wherein the transmission line structure includes:

a first conductive layer having a signal trace for transmitting and receiving the multi-band RF signals;

a second conductive layer configured as a ground plane; and a dielectric substrate positioned between the first conductive layer and the second conductive layer; and a plurality of ring resonators of different sizes and different resonant frequencies electromagnetically coupled to the transmission line structure to receive the multi-band RF signals, wherein each of the plurality of ring resonators is configured as a bandpass filter for generating a passband signal having a central frequency corresponding to the associated resonant frequency of the ring resonator, and the plurality of ring resonators are embedded in the dielectric substrate between the first and second conductive layers and electromagnetically coupled to the signal trace through direct contact.

19. An integrated multi-band bandpass filter, comprising:

an input circuit for receiving multi-band RF signals from a first RF circuit;

a plurality of ring resonators of different sizes and different resonant frequencies electromagnetically coupled to the input circuit to receive the multi-band RF signals, wherein each of the plurality of ring resonators is configured as a bandpass filter for generating a passband signal having a central frequency corresponding to the associated resonant frequency of the ring resonator, and the plurality of ring resonators of different sizes and different resonant frequencies include two or more subgroups of ring resonators, wherein each subgroup of ring resonators includes two or more ring resonators of closely-spaced resonant frequencies, wherein the two or more ring resonators operate as a single wideband bandpass filter having a bandwidth substantially equal to a combined bandwidth of the two or more ring resonators; and an output circuit coupled to the plurality of ring resonators and configured to receive the generated multiple passband signals and transmit the generated multiple passband signals to a second RF circuit.

20. The integrated multi-band bandpass filter of claim 19, wherein both the input circuit and the output circuit is the same transmission line structure.

* * * * *